US009842720B2

(12) United States Patent
Berk et al.

(10) Patent No.: US 9,842,720 B2
(45) Date of Patent: Dec. 12, 2017

(54) X-RAY TUBE UNIT

(71) Applicant: Siemens Aktiengesellschaft, Munich (DE)

(72) Inventors: Jan Berk, Hohenroda (DE); Jörg Freudenberger, Kalchreuth (DE); Ernst Neumeier, Aurachtal (DE); Jana Noack, Nuremberg (DE); Raimund Schwarz, Erlangen (DE); Lothar Werner, Weissenohe/Dorfhaus (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 4 days.

(21) Appl. No.: 14/601,308

(22) Filed: Jan. 21, 2015

(65) Prior Publication Data

US 2015/0213994 A1 Jul. 30, 2015

(30) Foreign Application Priority Data

Jan. 28, 2014 (DE) ..... 10 2014 201 514

(51) Int. Cl.
*H01J 35/16* (2006.01)
*H01J 35/06* (2006.01)
(Continued)

(52) U.S. Cl.
CPC ..... *H01J 35/16* (2013.01); *H01J 35/06* (2013.01); *H01J 35/12* (2013.01); *H05G 1/06* (2013.01);
(Continued)

(58) Field of Classification Search
CPC ..... H01J 2235/1216; H01J 2235/1275; H01J 2235/168; H01J 35/06; H01J 35/12;
(Continued)

(56) References Cited

U.S. PATENT DOCUMENTS 5,878,109 A * 3/1999 Negle ..... H05G 1/10 378/109
6,418,191 B1 * 7/2002 Fehre ..... H05G 1/20 362/21
(Continued)

FOREIGN PATENT DOCUMENTS

AT 130930 B 12/1932
CN 1933091 A 3/2007
(Continued)

OTHER PUBLICATIONS

Chinese Office Action dated Sep. 8, 2016 issued in corresponding Chinese Application No. 201510014725.0.
(Continued)

*Primary Examiner* — David E Smith
(74) *Attorney, Agent, or Firm* — Harness, Dickey & Pierce, PLC

(57) ABSTRACT

An x-ray tube unit includes an x-ray tube unit housing, in which a vacuum housing is disposed, which includes a high-voltage component. The vacuum housing includes an insulating medium circulating in the x-ray tube unit housing flowing around it. Further, a cathode module and an anode are disposed in the vacuum housing, the cathode module lying at high voltage and including an emitter which emits electrons when heating current is fed to it. In addition, a potential difference is present between the cathode module and the anode for accelerating the emitted electrons. In accordance with an embodiment of the invention a high-voltage feed, a heating transformer and a radiation protection component are integrated into the high-voltage component, the high-voltage component being filled at least partly with an electrically-insulating encapsulation material. This produces a compact and installation-friendly x-ray tube unit which has high operational safety.

17 Claims, 1 Drawing Sheet

(51) Int. Cl.
*H01J 35/12* (2006.01)
*H05G 1/06* (2006.01)
*H05G 1/10* (2006.01)

(52) U.S. Cl.
CPC ..... *H05G 1/10* (2013.01); *H01J 2235/1216* (2013.01); *H01J 2235/1275* (2013.01); *H01J 2235/168* (2013.01)

(58) Field of Classification Search
CPC . H01J 35/16; H01J 35/18; H05G 1/06; H05G 1/10
See application file for complete search history.

(56) References Cited

U.S. PATENT DOCUMENTS

| | | | | |
|---|---|---|---|---|
| 7,601,014 | B2 * | 10/2009 | Wandler ..... | H01R 13/53 439/181 |
| 2007/0064872 | A1 | 3/2007 | Freudenberger et al. | |
| 2008/0242134 | A1 | 10/2008 | Wandler | |
| 2009/0041192 | A1 * | 2/2009 | Sundaram ..... | H05G 1/04 378/103 |

FOREIGN PATENT DOCUMENTS

| | | | | |
|---|---|---|---|---|
| CN | 203387765 | U | 1/2014 | |
| DE | 760820 | C | 12/1953 | |
| DE | 19618122 | A1 | 11/1997 | |
| DE | 19621528 | A1 | 12/1997 | |
| DE | 102006054057 | A1 * | 5/2008 | ..... H01J 35/165 |
| DE | 102006054057 | A1 | 5/2008 | |
| DE | 102011081138 | A1 * | 9/2012 | ..... G01N 23/087 |
| DE | 102011081138 | A1 | 9/2012 | |
| JP | S58145098 | A | 8/1983 | |
| JP | 2007066655 | A * | 3/2007 | |

OTHER PUBLICATIONS

Office Action from corresponding Chinese patent application 201510014725.0, dated May 31, 2017.

* cited by examiner

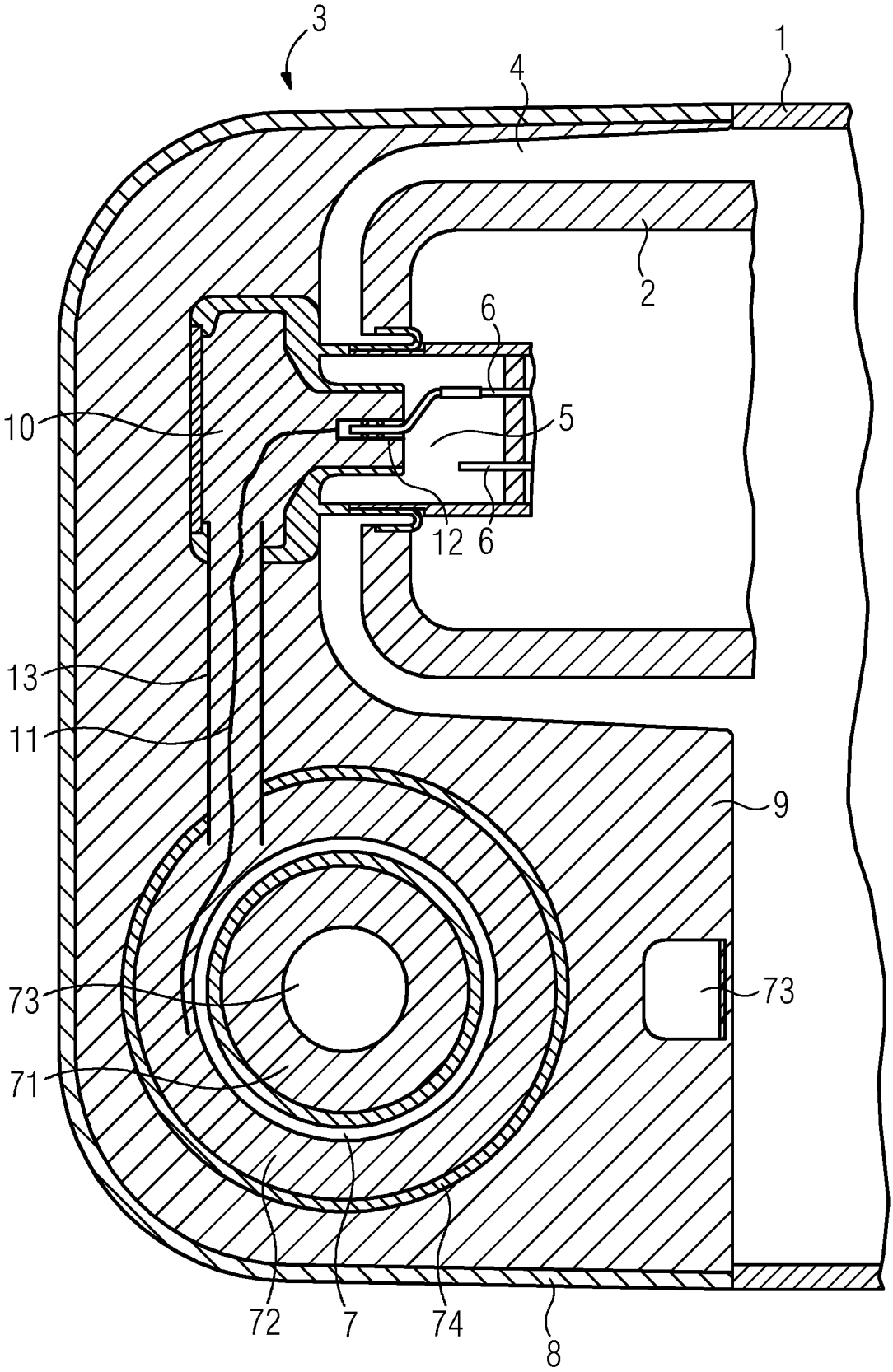
3
1
4
2
6
10
5
12
6
13
11
9
73
73
71
72
7
74
8

X-RAY TUBE UNIT

PRIORITY STATEMENT

The present application hereby claims priority under 35 U.S.C. §119 to German patent application number DE 102014201514.6 filed Jan. 28, 2014, the entire contents of which are hereby incorporated herein by reference.

FIELD

At least one embodiment of the invention generally relates to an x-ray tube unit.

Such an x-ray tube unit more specifically relates to one which comprises an x-ray tube unit housing in which a vacuum housing is disposed and a high-voltage component belonging to the x-ray tube unit housing. The vacuum housing has an insulating medium circulating in the x-ray tube unit housing flowing around it. A cathode module and an anode are disposed in the vacuum housing, wherein the cathode module lies at high voltage and has an emitter which emits electrons when fed with heating current. A potential difference for accelerating the emitted electrons is present between the cathode module and the anode. On acceleration of the electrons these are focused to an electron beam and meet at a focal point on the anode. The x-ray radiation arising here emerges from the x-ray tube unit and is used for example for medical imaging.

BACKGROUND

In the x-ray radiation generation used in medicine, high voltages of up to around 150 kV are employed, the heating currents are a result of the power requirements of the x-ray tubes. In the known x-ray tube units the high voltages and the heating currents units will mostly be fed to the cathode of the x-ray tubes or to the anode of the tubes via high voltage connector systems, mostly consisting of plug and plug socket.

High-voltage plug-in connector systems are necessary for production technology reasons and/or for maintenance technology reasons (replacement of components) in order to disconnect the x-ray tube unit from the high voltage generator. The high-voltage plug-in system in this case must guarantee both the high-voltage insulation and also prevent the escape of the insulating medium from the x-ray tube unit housing.

In some cases the high-voltage plug connector sockets in the x-ray tube unit are already integrated into encapsulated housing components (e.g. anode cover or cathode cover) or consist of individual function components (e.g. high-voltage plug tray). An example of a high-voltage connector socket is known for example from DE 10 2006 054 057 B4.

The required high voltage or acceleration voltage can either be made available at two poles (e.g. −75 kV at the cathode and correspondingly appr. +75 kV at the anode) or at one pole. The transformers or heating transformers necessary for the heating current generation are built into either the high-voltage generator or into the x-ray tube unit as functional components.

SUMMARY

At least one embodiment of the present invention is directed to a compact and installation-friendly x-ray tube unit which has high operational safety.

At least one embodiment of the present invention is directed to an x-ray tube unit. Advantageous embodiments of the invention are the subject matter of further claims in each case.

The x-ray tube unit of at least one embodiment includes an x-ray tube unit housing in which a vacuum housing is disposed and which includes a high-voltage component, wherein the vacuum housing has an insulating medium circulating in the x-ray tube unit housing flowing around it, and wherein a cathode module and an anode are disposed in the vacuum housing, wherein the cathode module lies at high voltage and has an emitter which emits electrons when heating current is supplied to it, and wherein a potential difference for accelerating the emitted electrons is present between the cathode module and the anode.

BRIEF DESCRIPTION OF THE DRAWINGS

A schematically presented example embodiment of an inventive x-ray tube unit in the drawing is explained in greater detail below with reference to the single figure, without being restricted thereto.

The x-ray tube unit is shown in the figure in a part longitudinal section.

DETAILED DESCRIPTION OF THE EXAMPLE EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

In the following description, illustrative embodiments may be described with reference to acts and symbolic representations of operations (e.g., in the form of flowcharts) that may be implemented as program modules or functional processes include routines, programs, objects, components, data structures, etc., that perform particular tasks or implement particular abstract data types and may be implemented using existing hardware at existing network elements. Such existing hardware may include one or more Central Processing Units (CPUs), digital signal processors (DSPs), application-specific-integrated-circuits, field programmable gate arrays (FPGAs) computers or the like.

Note also that the software implemented aspects of the example embodiments may be typically encoded on some form of program storage medium or implemented over some type of transmission medium. The program storage medium (e.g., non-transitory storage medium) may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The example embodiments not limited by these aspects of any given implementation.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The x-ray tube unit of at least one embodiment includes an x-ray tube unit housing in which a vacuum housing is disposed and which includes a high-voltage component, wherein the vacuum housing has an insulating medium circulating in the x-ray tube unit housing flowing around it, and wherein a cathode module and an anode are disposed in the vacuum housing, wherein the cathode module lies at high voltage and has an emitter which emits electrons when heating current is supplied to it, and wherein a potential difference for accelerating the emitted electrons is present between the cathode module and the anode.

In accordance with at least one embodiment of the invention a high-voltage feed, a heating transformer and a radiation protection component are integrated into the high-voltage component, wherein the high-voltage component is filled at least partly with an electrically-insulating encapsulation material.

Since a high-voltage feed, a heating transformer and a radiation protection component are integrated into the high-voltage component of at least one embodiment of the inventive x-ray tube unit, a compact-construction x-ray tube unit is obtained. In accordance with at least one embodiment of the invention the high-voltage component is filled at least partly with an electrically-insulating encapsulation material, through which heat is effectively dissipated from the heating transformer disposed in the high-voltage component.

In addition the high-voltage feed and the heating transformer are effectively insulated by the electrically-insulating encapsulation. The high-voltage component, because of the at least partial encapsulation with electrically-insulating material, is self-supporting, inherently stable and acceleration-resistant.

In accordance with an advantageous embodiment of the x-ray tube unit, the high-voltage component includes a component housing made of an electrically-conducting material. In particular when the electrically-conducting material involves a metal, the component housing can advantageously be embodied as a radiation protection component. This means that, in addition to effective heat dissipation and reliable insulation, especially good radiation protection is also obtained.

In accordance with an advantageous embodiment, the high-voltage component is filled in the area of the heating transformer—and thus partly—with an electrically-insulating encapsulation material and the remaining area is filled with an insulating medium. If the insulating medium with which the remaining area of the high-voltage component is filled involves the insulating medium circulating in the vacuum housing, then the remaining area of the high-voltage component advantageously forms an integrated volume equalization.

In accordance with a likewise advantageous embodiment, the high-voltage component is filled in the area of the high-voltage feed with an electrically-insulating encapsulation material and the remaining area is filled with an insulating medium. If the insulating medium with which the remaining area of the high-voltage component is filled involves the insulating medium circulating in the vacuum housing, then the remaining area of the high-voltage component likewise advantageously forms an integrated volume equalization.

In accordance with a further advantageous embodiment of the x-ray tube unit, the high-voltage component is completely filled with an electrically-insulating encapsulation material. Because of the greater high-voltage resistance compared to a liquid cooling medium, the components need a smaller spacing from one another. The high-voltage component thus possesses a lower volume and thus needs less installation space. A volume-optimized x-ray tube unit of at least one embodiment can thus be used in an advantageous manner as a high-power x-ray tube unit in a computed tomography system. Furthermore, through a complete encapsulation of the high-voltage component, a spatially fixed assignment of the modules disposed in the high-voltage component and thus in particular a rigid plug connector geometry is obtained, through which a "self-locating" high-voltage feed is obtained in a simple manner. The installation of the high-voltage component in the x-ray tube unit in accordance with at least one embodiment is thus especially simple.

Depending on the respective application, different encapsulation materials have proved advantageous. Thus the electrically-insulating encapsulation material can include for example of an epoxy resin, a silicon or a polyurethane. Should production technology require this, the electrically-insulating encapsulation material can contain at least one filler. If epoxy resin is used as an electrically-insulating encapsulation material, a quartz flour can be used as the filler for example.

The x-ray tube unit shown in the drawing has an x-ray tube unit housing 1, in which a vacuum housing 2 made of an electrically-insulating material (e.g. ceramic) is disposed. The x-ray tube unit housing 1 includes a high-voltage component 3 with a component housing 8 made of electrically-conducting material.

The high-voltage component 3 is connected by a non-positive or positive fit to the x-ray tube unit housing 1 in a known way with a flange connection which is not shown in the drawing, so that a fluid-tight connection is produced between the high-voltage component 3 and the x-ray tube unit housing 1.

In the form of embodiment shown the high-voltage component 3 includes a component housing 8, which is embodied as a radiation protection component. The vacuum housing 2 has a circulating insulating medium 4 flowing around it. A cathode module 5 and an anode not visible in the drawing are disposed in the vacuum housing 2. The cathode module 5 lies at high-voltage and has an emitter not shown in the drawing, which emits electrons when supplied with heating current via an emitter terminal 6. A potential difference lies between the cathode module 5 and the anode to accelerate the emitted electrons, which, on striking the anode, create x-rays. As a result of the heat generated in this process it is absolutely necessary to cool the vacuum housing 2 of the x-ray tubes. In the example embodiment shown the required cooling is undertaken at least partly by insulating medium 4.

In accordance with an embodiment of the invention, a high-voltage feed, which is not visible in the drawing because of the sectional view chosen, and a heating transformer 7 as well as the radiation protection component 8 are integrated into the high-voltage component 3, which is formed in the example embodiment shown by the component housing 8 of the high-voltage component 3. The high-voltage component 3 is filled in accordance with an embodiment of the invention at least partly with an electrically-insulating encapsulation material 9. In the example embodiment shown the component housing 8 is filled completely with the electrically-insulating encapsulation material 9.

The heating transformer 7 comprises a primary coil 71 and a secondary coil 72 as well as a transformer core 73 and a coil housing 74.

The emitter terminal 6 of the cathode module 5 is supplied via a terminal 10 with heating current, which is provided by the heating transformer 7. The secondary coil 72 of the heating transformer 7 is connected for this purpose via a heating current line 11, having a connector pin 12 at its free end, to the emitter terminal 6. The heating current line 11 is routed here in a tubular conductor 13 which includes of an electrically conducting material and lies at high-voltage. The tubular conductor 13 is attached in the example embodiment shown with its one end to the housing 74 of the heating transformer 7 and with its other end to the cathode terminal 10. Both the cathode terminal 10 and also the tubular conductor 13 are completely filled with the electrically-insulating encapsulation material 9. Through this arrangement the heating current line 11 and the connector pin 12 are optimally electrically insulated and spatially irreversibly fixed.

Since the component housing 8 is filled completely with the electrically-insulating encapsulation material 9 which has a greater high-voltage resistance compared to a liquid cooling medium, the elements (cathode terminal 10, high-voltage feed, heating transformer 7, radiation protection component 8, tubular conductor 13) disposed in the high-voltage component 3 only need to be a small distance apart from one another. The high-voltage component 3 thus has a smaller volume and needs a correspondingly small installation space.

Furthermore a complete encapsulation of the high-voltage component 3 means that a spatially-fixed assignment of the elements disposed in the high-voltage component 3 and thus in particular a rigid connector socket geometry is achieved, through which in a simple manner a "self-locating" high-voltage feed and a "self-locating" heating current feed is obtained. The installation of the high-voltage component 3 in the x-ray tube unit is thus especially simple.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a tangible computer readable medium and is adapted to perform any one of the aforementioned methods when run on a computer device (a device including a processor). Thus, the tangible storage medium or tangible computer readable medium, is adapted to store information and is adapted to interact with a data processing facility or computer device to execute the program of any of the above mentioned embodiments and/or to perform the method of any of the above mentioned embodiments.

The tangible computer readable medium or tangible storage medium may be a built-in medium installed inside a computer device main body or a removable tangible medium arranged so that it can be separated from the computer device main body. Examples of the built-in tangible medium include, but are not limited to, rewriteable non-volatile memories, such as ROMs and flash memories, and hard disks. Examples of the removable tangible medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

Although the invention has been explained in detail by a preferred example embodiment, the invention is not restricted by the example embodiment shown in the drawing. Instead other variants of the inventive solution can also be derived herefrom by the person skilled in the art, without departing in doing so from the underlying inventive idea of providing a high-voltage component for an x-ray tube unit, into which a high-voltage feed, a heating transformer and a radiation protection component are integrated, wherein the high-voltage component is filled at least partly with an electrically-insulating encapsulation material.

What is claimed is:

1. An x-ray tube unit comprising:

an x-ray tube unit housing, a vacuum housing being disposed in the x-ray tube unit housing, the x-ray tube unit housing including a high-voltage component, a high-voltage feed, a heating transformer and a radiation protection component integrated into the high-voltage component, wherein the high-voltage component is filled at least partly with an electrically-insulating encapsulation material, and wherein the vacuum housing includes an insulating medium within the x-ray tube unit housing, the x-ray tube housing being around the insulating medium, a cathode module and an anode disposed in the vacuum housing, the cathode module lying at high voltage and including an emitter to emit electrons when heating current is fed to the cathode module, a potential difference being present for accelerating the emitted electrons between the cathode module and the anode, and a heating current line connected through a conductor to the transformer, wherein the high-voltage component is completely filled with the electrically-insulating encapsulation material that encapsulates the heating transformer, the heating current line and the conductor.

2. The x-ray tube unit of claim 1, wherein the high-voltage component comprises a component housing made of an electrically-conducting material.

3. The x-ray tube unit of claim 2, wherein the component housing is embodied as a radiation protection component.

4. The x-ray tube unit of claim 1, wherein the high-voltage component is filled with the electrically-insulating encapsulation material in an area of the heating transformer and a remainder of the area is filled with an insulating medium.

5. The x-ray tube unit of claim 1, wherein the electrically-insulating encapsulation material includes an epoxy resin.

6. The x-ray tube unit of claim 1, wherein the electrically-insulating encapsulation material includes a silicon.

7. The x-ray tube unit of claim 1, wherein the electrically-insulating encapsulation material includes a polyurethane.

8. The x-ray tube unit of claim 1, wherein the electrically-insulating encapsulation material includes at least one filler.

9. The x-ray tube unit of claim 2, wherein the electrically-insulating encapsulation material includes an epoxy resin.

10. The x-ray tube unit of claim 2, wherein the electrically-insulating encapsulation material includes a silicon.

11. The x-ray tube unit of claim 2, wherein the electrically-insulating encapsulation material includes a polyurethane.

12. The x-ray tube unit of claim 2, wherein the electrically-insulating encapsulation material includes at least one filler.

13. The x-ray tube unit of claim 1, wherein the electrically-insulating encapsulation material includes an epoxy resin.

14. The x-ray tube unit of claim 1, wherein the electrically-insulating encapsulation material includes a silicon.

15. The x-ray tube unit of claim 1, wherein the electrically-insulating encapsulation material includes a polyurethane.

16. The x-ray tube unit of claim 1, wherein the electrically-insulating encapsulation material includes at least one filler.

17. An x-ray tube unit comprising:

an x-ray tube unit housing, a vacuum housing being disposed in the x-ray tube unit housing, the x-ray tube unit housing including a high-voltage component, a high-voltage feed, a heating transformer and a radiation protection component integrated into the high-voltage component, wherein the high-voltage component is filled at least partly with an electrically-insulating encapsulation material, and wherein the vacuum housing includes an insulating medium within the x-ray tube unit housing, the x-ray tube housing being around the insulating medium, a cathode module and an anode disposed in the vacuum housing, the cathode module lying at high voltage and including an emitter to emit electrons when heating current is fed to the cathode module, a potential difference being present for accelerating the emitted electrons between the cathode module and the anode, a heating current line connected through a conductor to the transformer, wherein the high-voltage component is filled with the electrically-insulating encapsulation material in an area of the high-voltage feed and a remainder of the area is filled with an insulating medium, the transformer, the heating current line and the conductor is encompassed by the encapsulation material.

* * * * *